United States Patent [19]

Shacket

[11] Patent Number: 4,506,892

[45] Date of Patent: Mar. 26, 1985

[54] BALL AND TUBE GAME APPARATUS AND METHOD

[76] Inventor: Sheldon R. Shacket, 5142 N. St. Louis Ave., Chicago, Ill. 60625

[21] Appl. No.: 578,084

[22] Filed: Feb. 8, 1984

[51] Int. Cl.[3] ..... A63F 9/08

[52] U.S. Cl. ..... 273/153 R; 209/645; 209/659; 434/302

[58] Field of Search ..... 273/153 R; 434/300, 434/302; 209/645, 659

[56] References Cited

PUBLICATIONS

More Science Braintwisters and Paradoxes, by Christopher P. Jargocki, publ. by Van Nostrand Reinhold Co., N.Y., copyright 1983, pp. 4 and 49.

*Primary Examiner*—Anton O. Oechsle

*Attorney, Agent, or Firm*—Marshall, O'Toole, Gerstein, Murray & Bicknell

[57] ABSTRACT

A toy or game comprising an elongated transparent tube, the tube containing a column of sand and a sphere or ball. According to the method of the invention, the sphere is moved through the column of sand from one end of the tube to the other.

13 Claims, 3 Drawing Figures

BALL AND TUBE GAME APPARATUS AND METHOD

SUMMARY OF THE INVENTION

The present invention relates generally to a mechanical toy which may be utilized as a game or a puzzle and a method of operating said toy. More particularly, the invention describes a novel toy or game which employs an elongated transparent tube containing both a fine granular material such as sand and a solid sphere or ball.

The apparatus of the invention can be used to challenge an operator to manipulate the device in such a way as to cause the ball to travel vertically through a column of said from one end of the tube to the other end in a specified length of time. The method of the invention provides a procedure for obtaining this effect. This unique puzzle solution is the only method possible to successfully operate the device.

The object of the game is to move the ball from one end of the tube to the other. The method and apparatus allows an operator to manipulate the device in a series of periodic upward strokes thus permitting the ball to displace a volume of sand. With each successive stroke the ball gradually advances from the bottom-most vertical position in the tube to the top-most position, emerging from beneath the fine sand vertically in an upward direction.

This method is unique in that it does not follow a logical sequence of events. That is to say, a person given the task of moving a ball from one end of a tube to another is predisposed by the experience of gravity to place the ball in the top-most vertical position in the tube. The "expected" result is that the ball would sink deeper into the sand and slowly, through a sedimentary process, gravitate to the bottom-most vertical position in the tube when acted upon by any type of motion that is a vibrating or lateral movement or combination thereof, causing the ball to, in effect, "sink" to the bottom of the tube in the same manner as a large rock over a period of time would sink into the sand on a beach.

A second "expected" solution to the task of causing the ball to travel through the sand from one end of the tube to the other end of said tube is to place the tube in a horizontal position and have the operator turn and manipulate the tube in an effort to cause the ball to be surrounded by the sand, e.g., rotating the tube around its longitudinal axis while placing the tube in a variety of near horizontal angles. Through this sort of manipulation the operator would attempt to gradually cause the ball to move laterally in one direction. This solution, however, is totally unsuitable and will not provide the desired result or effect.

The method of the present invention, as enumerated fully in the following detailed description, discloses that the operator can achieve said effect in a diametrically opposite manner than "expected". Moving the ball from one end of the tube to the other can only be accomplished by positioning the ball in the bottom of the vertical tube and causing the ball to travel vertically upwards and emerge in the uppermost vertical position of the tube through the sand.

The apparatus of the invention includes an elongated tubular sidewall manufactured of a clear rigid plastic, Plexiglas, or a similar material and a pair of circular end pieces, which can be clear or opaque, fabricated to mate with the tubular sidewall to define an enclosed tube. The tube interior contains a dry granular material, such as sand, and a sphere or ball. The diameter of the ball should be less than the internal diameter of the enclosed tube and the ball should be manufactured of a dense material, such as metal, so that it may readily displace the granular material during its upward travel.

These, together with other objects, features and advantages which will become subsequently apparent, reside in the details of construction and operation as more fully hereinafter described and claimed, reference being made to the accompanying drawings forming a part hereof, wherein like numerals refer to like parts throughout.

DETAILED DESCRIPTION OF THE DRAWINGS

Figure 1:
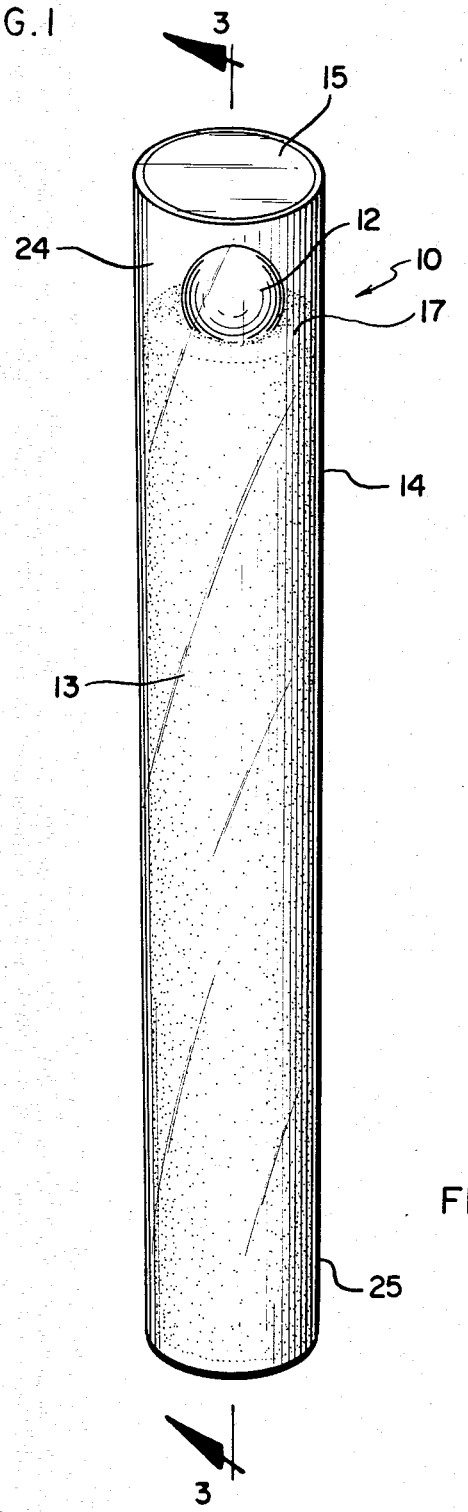
FIG. 1 is a perspective view of the mechanical toy of the present invention.
Figure 3:
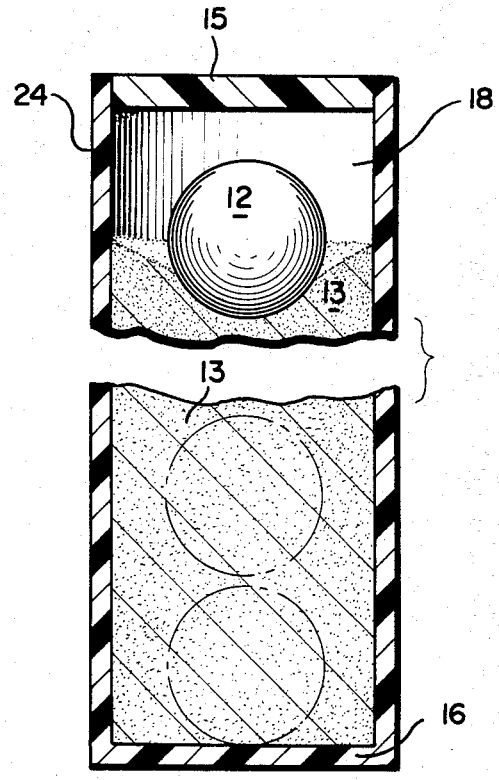
FIG. 3 is a fragmentary sectional view of the mechanical toy of FIG. 1.

FIGS. 1 and 3 illustrate an embodiment of the toy or game of the present invention comprising a clear, enclosed tube 10, a ball 12, and a column of fine granular material or sand 13. Tube 10, manufactured of a rigid plastic material, has a transparent tubular sidewall 14, and a pair of substantially identical clear, circular inserts 15, 16 having a diameter equal to the interior diameter of tube 10, which are glued to sidewall 14, thereby defining a closed elongated structure having a first end portion 24 and a second end portion 25. Tube 10 has a longitudinal axis passing through the centers of circular inserts 15, 16. The length of this axis is substantially greater than the diameter of inserts 15, 16, i.e., at least three times, and ideally five to six times this diameter.

A top surface 17 of sand 13, sidewall 14, and circular insert 15 define a first ball-receiving chamber 18 in first end portion 24 of tube 10 when tube 10 is held in the vertical position. The amount of sand 13 in tube 10 should be sufficient to prohibit ball 12 from rolling along a horizontal surface of sand 13 when tube 10 is held in a horizontal position. However, too much sand should not be used. The height of the sand in tube 10 should be such so as to insure that the distance between top surface 17 and insert 15 is greater than twice the diameter of ball 12. The optimum level of sand 13 is dependent on the diameter of ball 12, but in all cases should exceed 75 percent of the length of tube 10 as measured along the axis of tubular sidewall 14, and most preferably 90 percent of this length.

The movement of ball 12 through sand 13 is attributable in large part to the inertia of ball 12, i.e., its tendency to continue to move upward through sand 13 in response to a periodic shaking motion, notwithstanding the momentary cessation of the applied force. Thus ball 12 is preferably manufactured from a dense material such as metal. A solid iron or steel sphere is preferred. For optimum results, the diameter of ball 12 should excede 50 percent of the interior diameter of tube 10.

Figure 2:
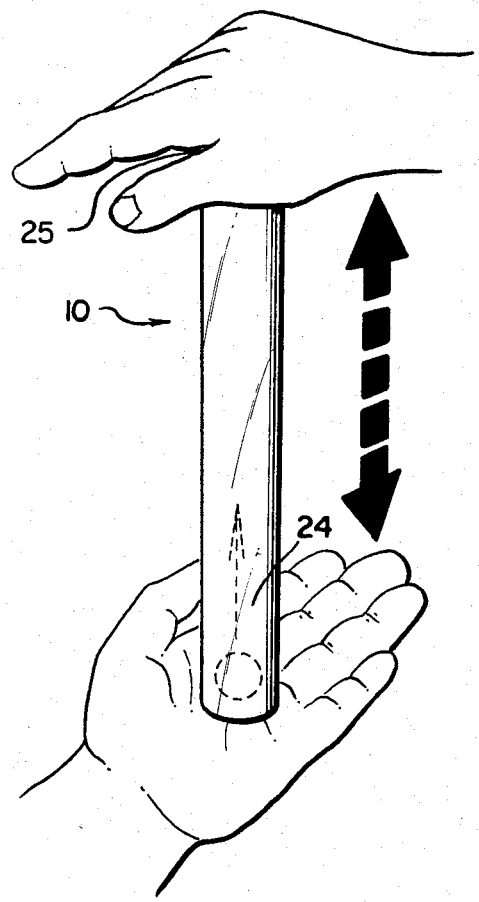
FIG. 2 is a second perspective view, wherein the mechanical toy has been inverted from its FIG. 1 position, showing a manipulating procedure according to the method of the invention.

FIG. 2 illustrates the method or sequence of manipulations which enables an operator to move ball 12 from first chamber 18, adjacent end portion 24, to second end portion 25 of tube 10, adjacent insert 16. This can be accomplished by inverting tube 10 from its FIG. 1 position to the position shown in FIG. 2, placing first end portion 24 in a downward location and ball 12 adjacent.

The operator places one hand alongside the top of tube 10, adjacent end portion 25, and the palm of the other hand on the bottom of tube 10, adjacent end portion 24. Ball 12 will be in the lower portion of tube 10 and close to insert 15. The operator proceeds to vertically move tube 10 in an upward direction using short, rapid strokes. The momentum of the stroke should be sufficient to permit ball 12 to remain in motion, after the tube itself has stopped. Thus a rapid, chopping motion, using short intermittent strokes, is preferred. It has been found that moving the tube the approximate distance of one-fourth the length of tube 10 at a frequency of approximately 160 combined vertical up and down movements per minute provides satisfactory results and will cause ball 12 to traverse the entire length of tube 10 from the lowermost first end portion 24 to the top second end portion 25 in a short period of time. For example, when tube 10 has a height of 25 cm, a diameter of 5 cm, and ball 12 is a steel sphere approximately 2 cm in diameter, the ball can be moved from end portion 24 to end portion 25 in one minute or less. The exact time the travel will take is dependent on the amount of skill the operator has acquired in perfecting the aforementioned operating procedure.

What is claimed:

1. A mechanical toy comprising:

an elongated, transparent tubular sidewall having a longitudinal axis and a circular cross-section;

a pair of circular inserts, each said insert mounted adjacent an end portion of said tubular sidewall and cooperating with said sidewall to define an enclosed tube;

a fine granular material in said enclosed tube, the height of said granular material being at least seventy-five percent of said longitudinal axis when said tube is in a vertical position;

a ball-receiving chamber in said enclosed tube, said chamber defined by said tubular sidewall, a circular insert, and a top surface of said granular material when said tube is in a vertical position;

a sphere in said enclosed tube, said sphere having a diameter in excess of 50 percent of the diameter of said tubular sidewall circular cross-section and a mass sufficient to displace a quantity of said fine granular material when subjected to a periodic upward thrust.

2. The mechanical toy of claim 1 wherein said elongated transparent sidewall is formed from a rigid plastic.

3. The mechanical toy of claim 1 wherein said circular inserts are formed from a rigid plastic.

4. The mechanical toy of claim 3 wherein said circular inserts are transparent.

5. The mechanical toy of claim 1 wherein said granular material comprises sand.

6. The mechanical toy of claim 1 wherein said sphere is manufactured from a metallic material.

7. The mechanical toy of claim 1 wherein said sphere comprises a solid ferrous ball.

8. The mechanical toy of claim 1 wherein said tubular sidewall longitudinal axis is at least four times the length of a diameter of one of said circular inserts.

9. A method of moving a sphere through a column of granular material, said sphere and granular material contained in a sealed elongated transparent tube, said method comprising the following steps in sequence:

placing said tube in a vertical position with said sphere in a lower end portion of said tube;

grasping said tube between the palms of one's hands;

moving said tube in a vertically upward direction employing a short, intermitent stroke; and repeating said step of moving said tube until said sphere reaches the top end portion of said tube.

10. The method of claim 9 wherein said granular material comprises sand.

11. The method of claim 9 wherein said sphere is manufactured from a metallic material.

12. The method of claim 9 wherein said sphere comprises a solid ferrous ball.

13. The method of claim 9 wherein said elongated transparent tube is a rigid plastic.

* * * * *